US011273536B2

(12) United States Patent
Chen

(10) Patent No.: US 11,273,536 B2
(45) Date of Patent: Mar. 15, 2022

(54) FIXTURE STRUCTURE

(71) Applicant: Chien-San Chen, Taichung (TW)

(72) Inventor: Chien-San Chen, Taichung (TW)

( * ) Notice: Subject to any disclaimer, the term of this patent is extended or adjusted under 35 U.S.C. 154(b) by 78 days.

(21) Appl. No.: 16/914,192

(22) Filed: Jun. 26, 2020

(65) Prior Publication Data

US 2021/0402571 A1 Dec. 30, 2021

(51) Int. Cl.
*B25B 5/06* (2006.01)

(52) U.S. Cl.
CPC ..... *B25B 5/068* (2013.01)

(58) Field of Classification Search
None
See application file for complete search history.

(56) References Cited

U.S. PATENT DOCUMENTS 8,424,856 B2 * 4/2013 Lombardi ..... B25B 5/068 269/6

* cited by examiner

*Primary Examiner* — Tyrone V Hall, Jr.
*Assistant Examiner* — Abbie E Quann

(57) ABSTRACT

A fixture structure contains: a first body, a second body, and an actuation rod. The first body includes a first clamp, a holding grip, a drive mechanism, and a press lever. The actuation rod includes two extensions. The second body includes a base, a second clamp, and an accommodation groove. A locking mechanism is disposed in the base and includes two release button, two springs, and two positioning sheets. A respective positioning sheet has a flat section, two upward tilted guide sections, and a through orifice. The respective positioning sheet is urged by the respective spring to push the flat section to engage into the accommodation groove. The respective release button has multiple posts aligned with the respective positioning sheet. When the respective release button is pressed, the multiple posts push the respective positioning sheet so that the flat section removes from the accommodation groove.

1 Claim, 8 Drawing Sheets

FIXTURE STRUCTURE

FIELD OF THE INVENTION

The present invention relates to a fixture structure which contains the second body connected with or removed from the actuation rod by ways of the locking mechanism so as to clamp the workpiece quickly and easily.

BACKGROUND OF THE INVENTION

A conventional fixture is applied to clamp a workpiece made of wood by pressing a pressing lever to drive two bodies to move close to or away from each other, thus clamping the workpiece.

However, when clamping the workpiece, the second body is moved to two ends of an actuation rod and is fixed, thus causing inconvenient operation.

The present invention has arisen to mitigate and/or obviate the afore-described disadvantages.

SUMMARY OF THE INVENTION

The primary aspect of the present invention is to provide a fixture structure which contains the second body connected with or removed from the actuation rod by ways of the locking mechanism so as to clamp the workpiece quickly and easily.

To obtain the above mentioned aspect, a fixture structure provided by the present invention contains: a first body, a second body, and an actuation rod.

The first body includes a first clamp and a holding grip, and the actuation rod is movably accommodated and moves in the first body via the second body. The first body further includes a drive mechanism configured to pull the actuation rod, and a press lever fixed on a bottom of the first body and configured to control the drive mechanism.

The actuation rod includes two extensions horizontally extending from two ends thereof, the second body includes a base, a second clamp corresponding to the first clamp, and an accommodation groove configured to receive the actuation rod.

A locking mechanism is disposed in the base and includes two release button, two springs, and two positioning sheets. A respective release button is arranged on each of two sides of the base, a respective spring is located inside the respective release button, and a respective positioning sheet has a flat section and two upward tilted guide sections. A respective upward tilted guide section is located beside each of two sides of the flat section, the respective positioning sheet has a through orifice defined on a center thereof, and the respective positioning sheet is located at the base and is urged by the respective spring to push the flat section to engage into the accommodation groove.

The respective release button has multiple posts aligned with the respective positioning sheet. When the respective release button is pressed, the multiple posts push the respective positioning sheet so that the flat section removes from the accommodation groove.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
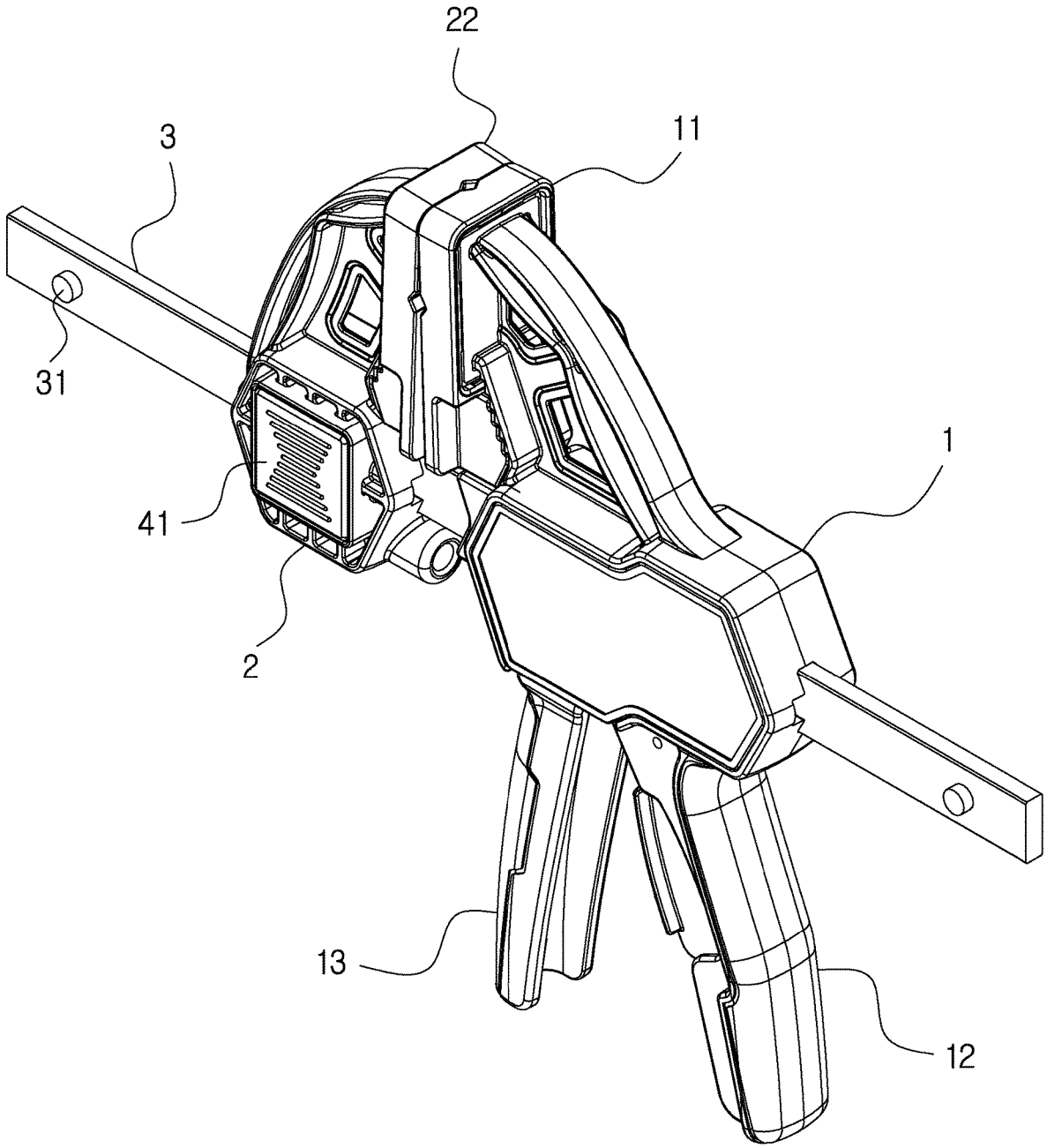
FIG. 1 is a perspective view showing the assembly of a fixture structure according to a preferred embodiment of the present invention.
Figure 2:
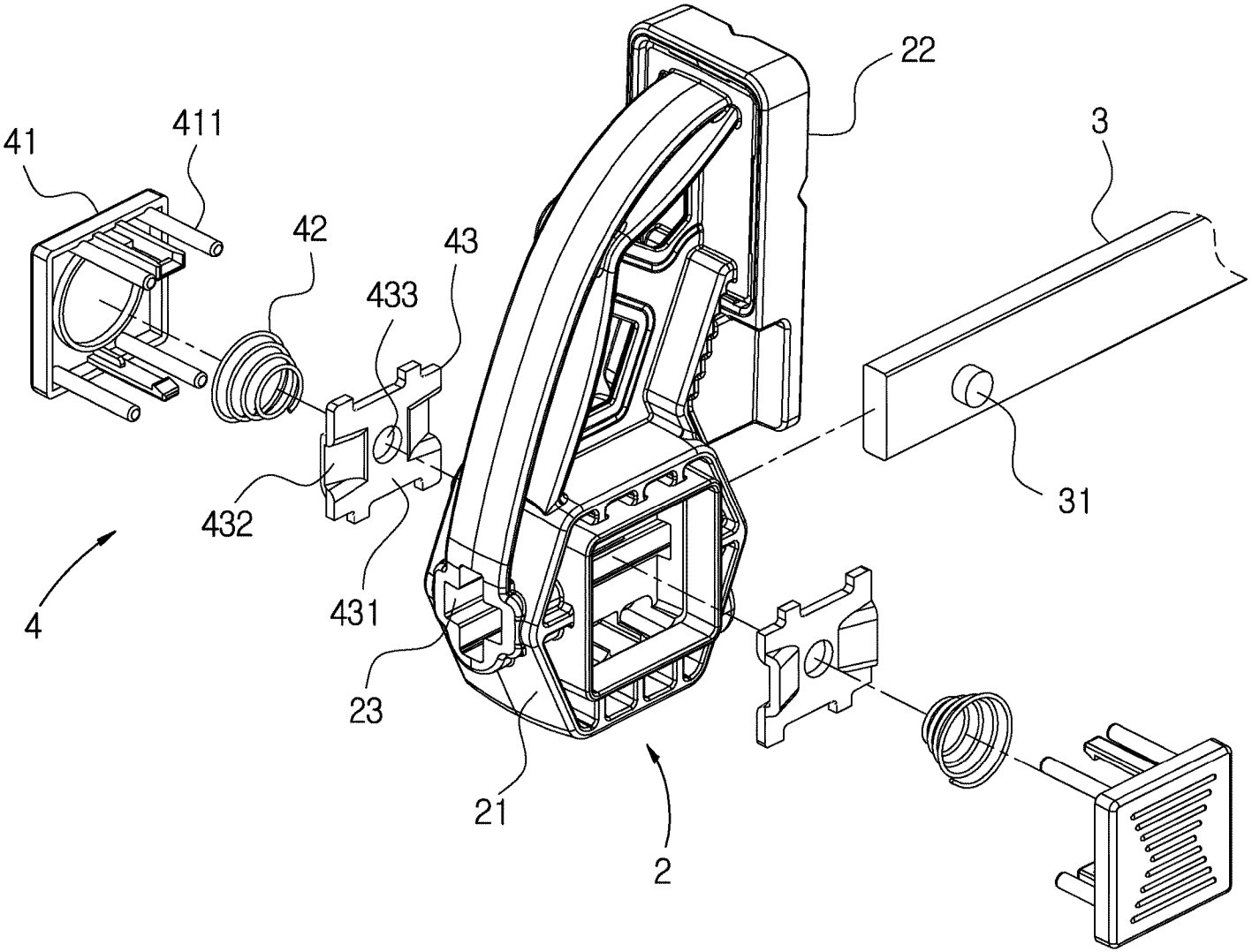
FIG. 2 is a perspective view showing the exploded components of the fixture structure according to the preferred embodiment of the present invention.

With reference to FIGS. 1 and 2, a fixture structure according to a preferred embodiment of the present invention comprises: a first body 1, a second body 2, and an actuation rod 3.

The first body 1 includes a first clamp 11 and a holding grip 12, and the actuation rod 3 is movably accommodated and moves in the first body 1 via the second body 2. The first body 1 further includes a drive mechanism (because the drive mechanism is a well-known art, further remarks are omitted) configured to pull the actuation rod 3, and a press lever 13 fixed on a bottom of the first body 1 and configured to control the drive mechanism.

The actuation rod 3 includes two extensions 31 horizontally extending from two ends thereof. The second body 2 includes a base 21, a second clamp 22 corresponding to the first clamp 11, and an accommodation groove 23 configured to receive the actuation rod 3.

A locking mechanism 4 is disposed in the base 21 and includes two release button 41, two springs 42, and two positioning sheets 43, wherein a respective release button 41 is arranged on each of two sides of the base 21, a respective spring 42 is located inside the respective release button 41, and a respective positioning sheet 43 has a flat section 431 and two upward tilted guide sections 432, wherein a respective upward tilted guide section 432 is located beside each of two sides of the flat section 431, wherein the respective positioning sheet 43 has a through orifice 433 defined on a center thereof, and the respective positioning sheet 43 is located at the base 21 and is urged by the respective spring 42 to push the flat section 431 to engage into the accommodation groove 23.

The respective release button 41 has multiple posts 411 aligned with the respective positioning sheet 43, wherein when the respective release button 41 is pressed, the multiple posts 411 push the respective positioning sheet 43 so that the flat section 431 removes from the accommodation groove 23.

Figure 3:
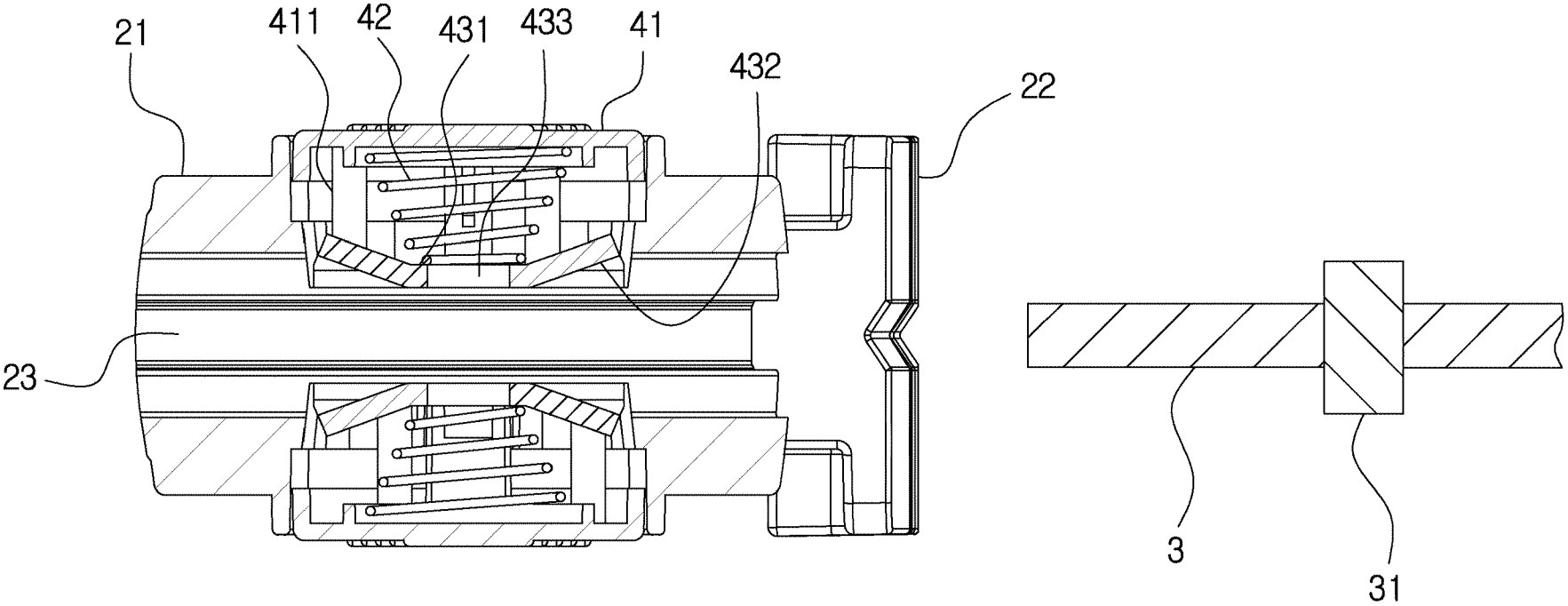
FIG. 3 is a cross view showing the operation of the fixture structure according to the preferred embodiment of the present invention.
Figure 4:
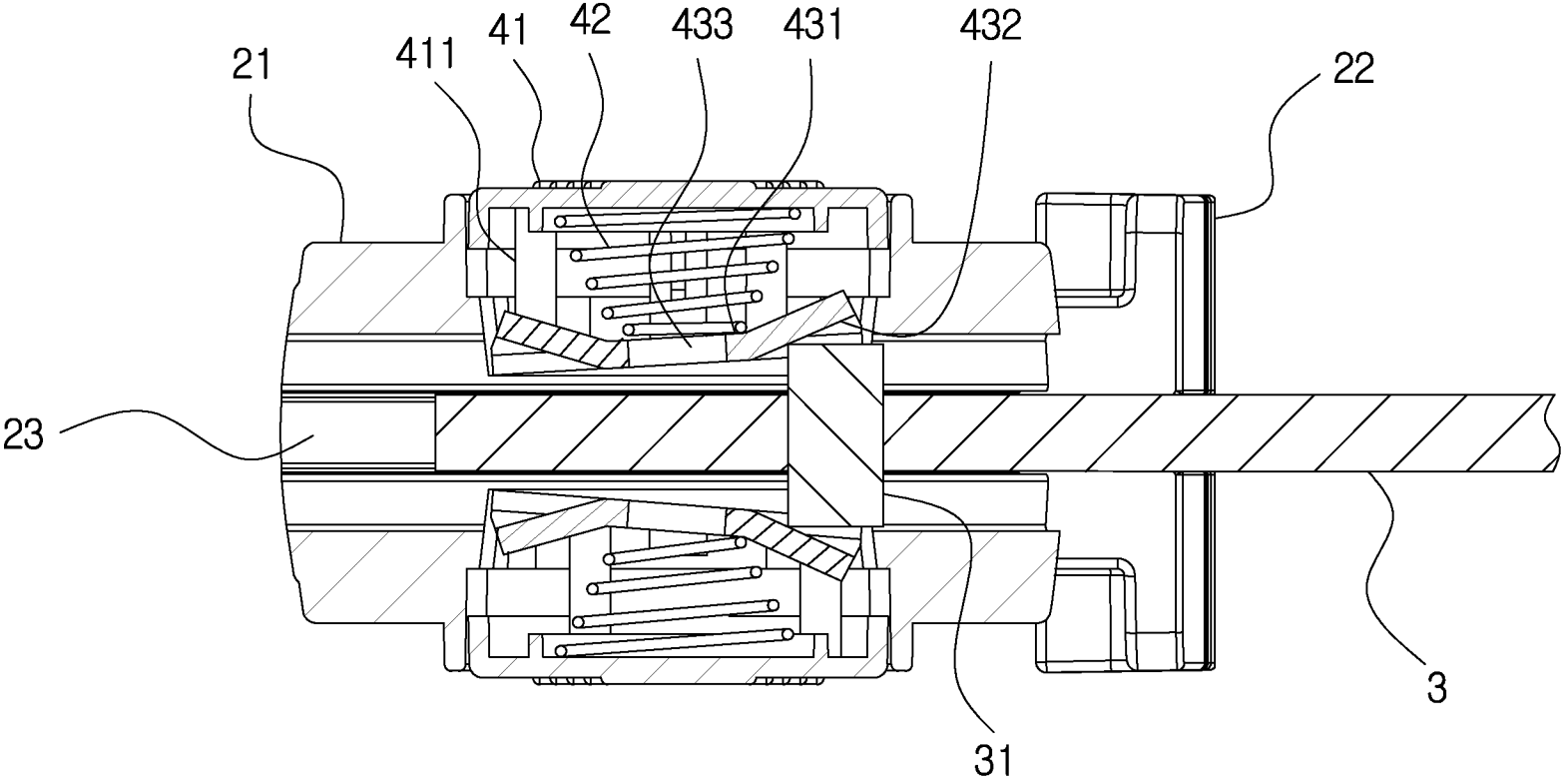
FIG. 4 is another cross sectional view showing the operation of the fixture structure according to the preferred embodiment of the present invention.
Figure 5:
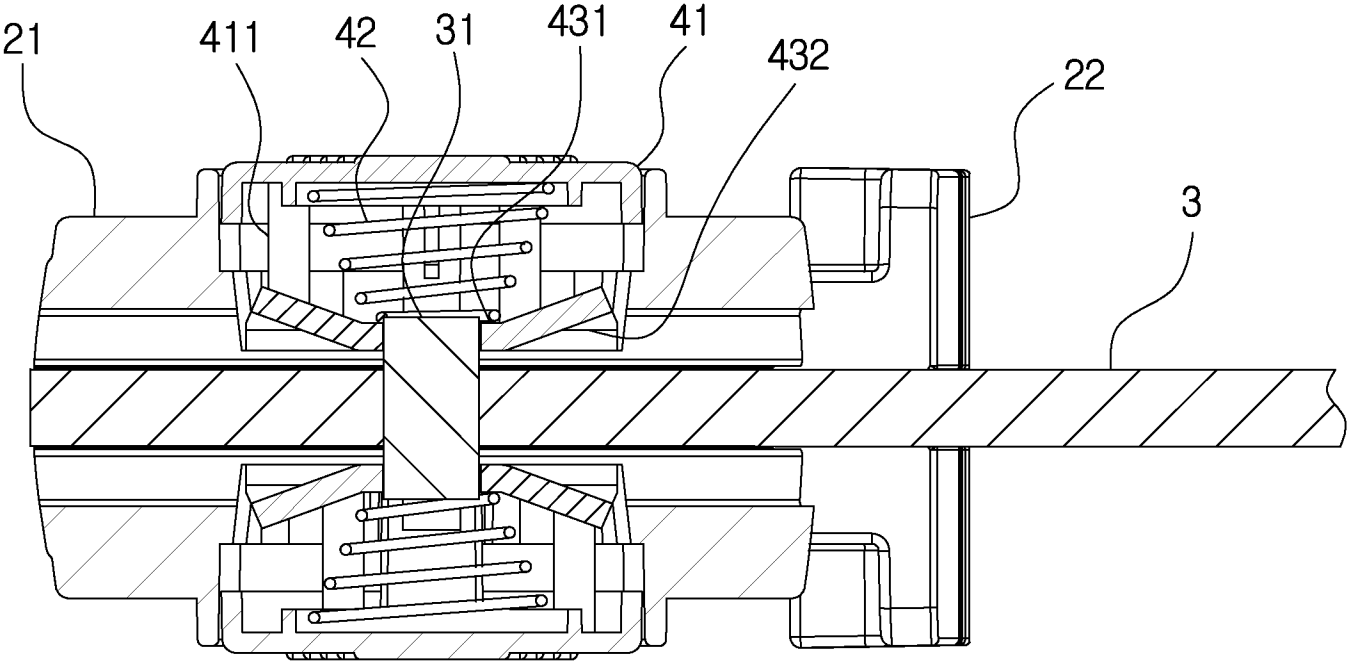
FIG. 5 is also another cross sectional view showing the operation of the fixture structure according to the preferred embodiment of the present invention.
Figure 6:
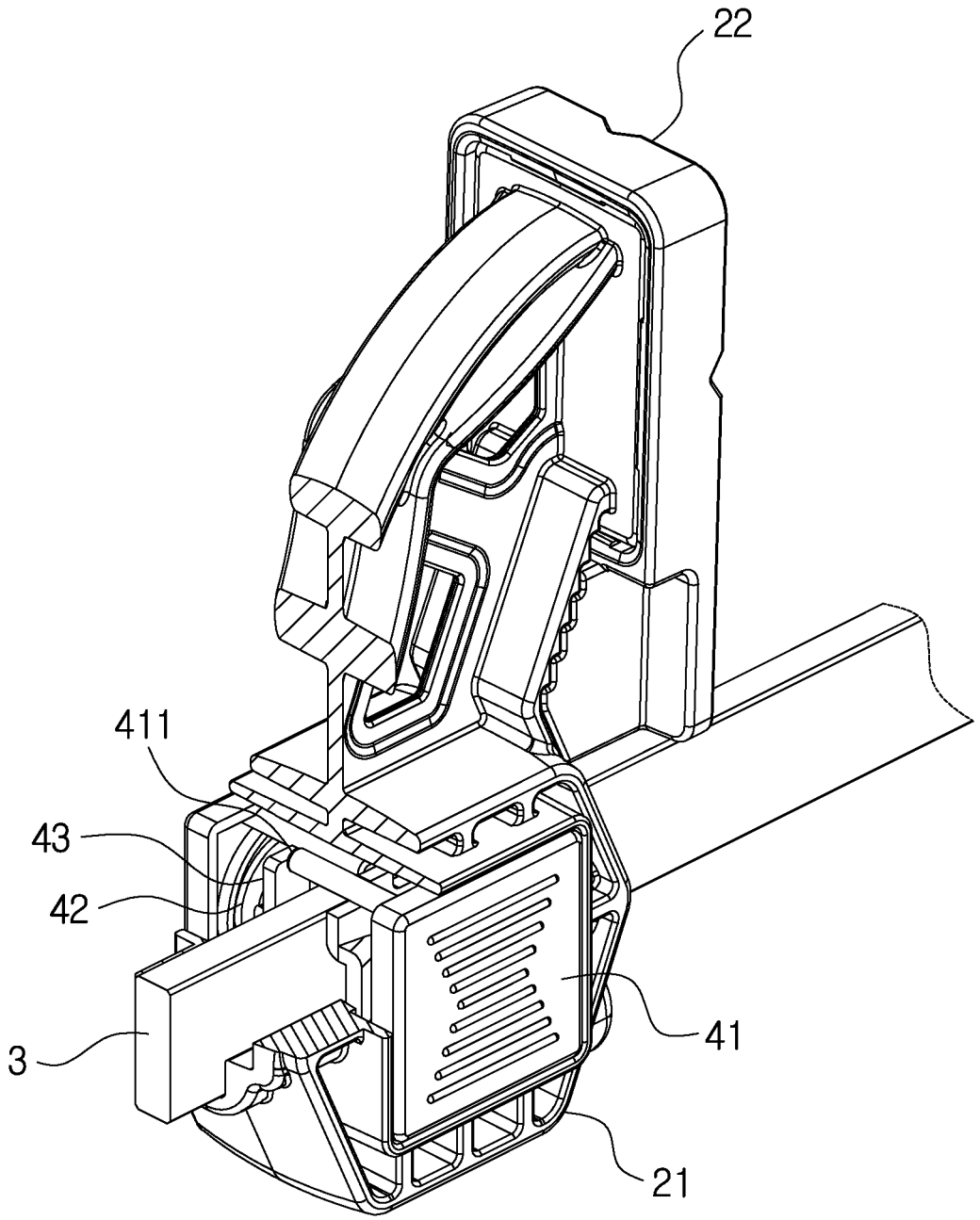
FIG. 6 is a perspective view showing the operation of the fixture structure according to the preferred embodiment of the present invention.
Figure 7:
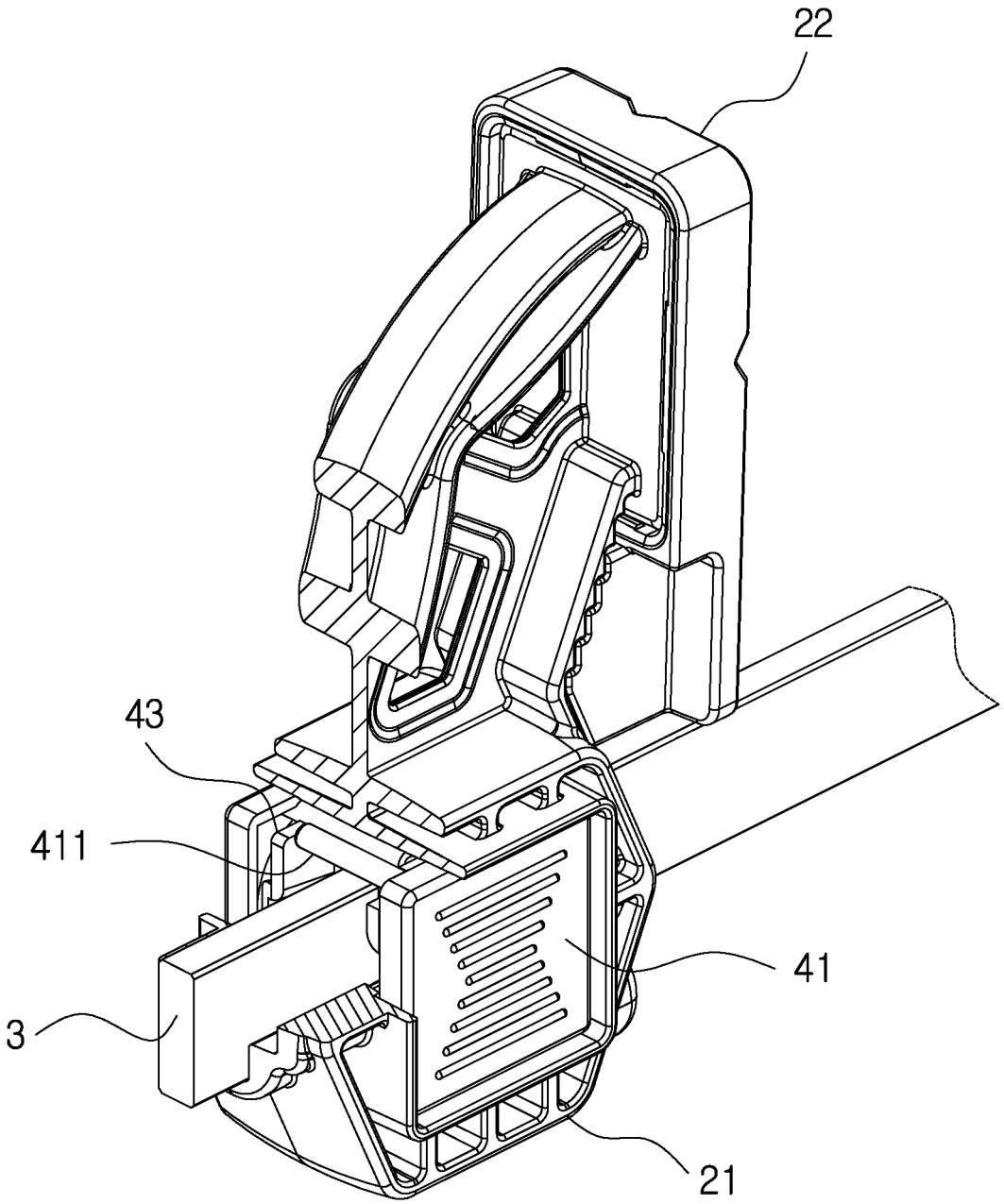
FIG. 7 is another perspective view showing the operation of the fixture structure according to the preferred embodiment of the present invention.
Figure 8:
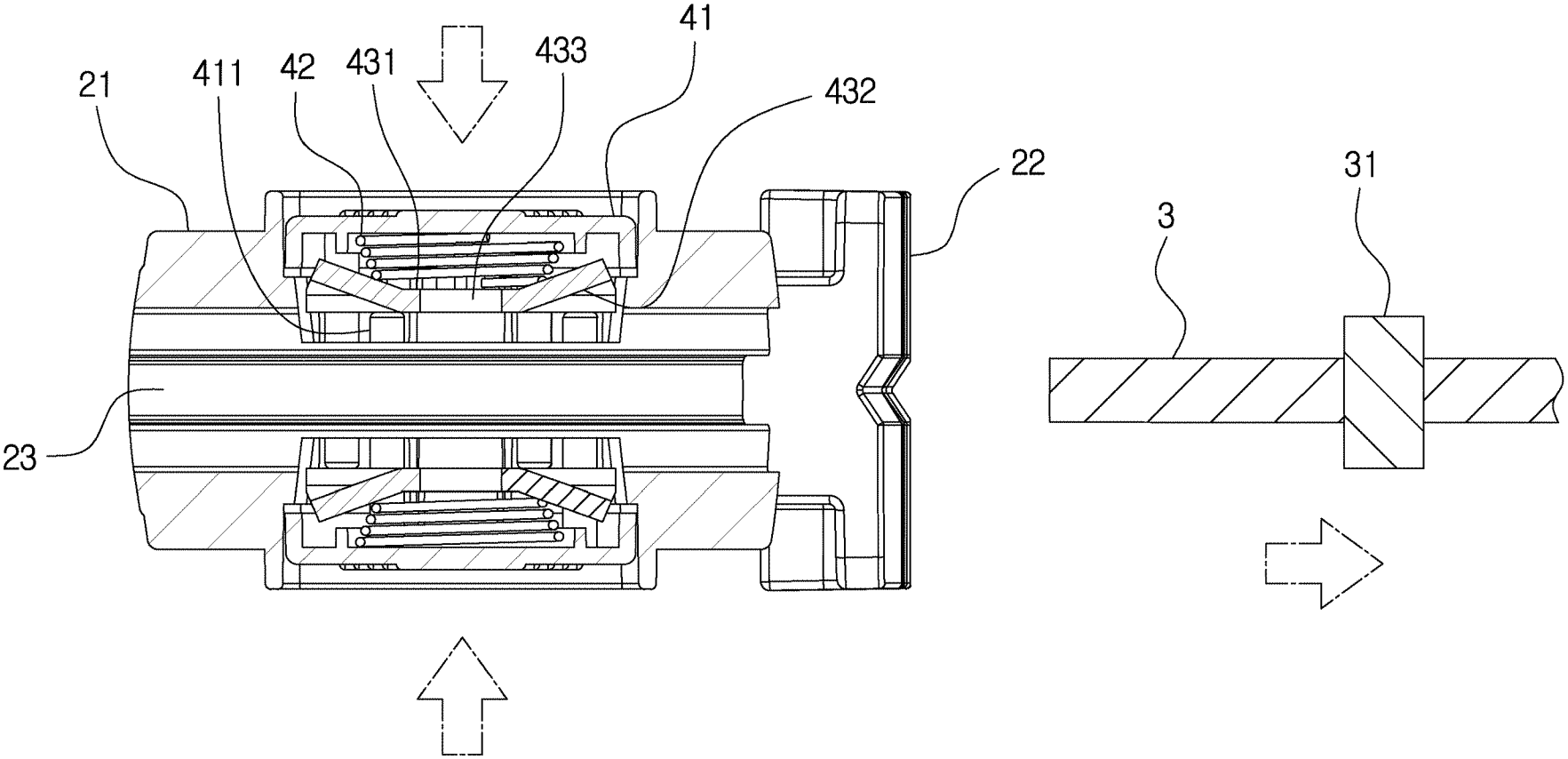
FIG. 8 is still another cross sectional view showing the operation of the fixture structure according to the preferred embodiment of the present invention.

Referring to FIGS. 3-8, when desiring to connect the second body 2 with the actuation rod 3, the actuation rod 3 is inserted through the accommodation groove 23 (as shown in FIG. 3), and a respective extension 31 contacts with the respective upward tilted guide section 432, then the respective positioning sheet 43 is pushed to move outward (as shown in FIG. 4) so that the respective extension 31 moves into the flat section 431. After the through orifice 433 of the respective positioning sheet 43 is aligned with the respective extension 31, the respective positioning sheet 43 is forced by the respective spring 42 to engage with the respective extension 31 (as shown in FIG. 5). When desiring to remove the second body 2 from the actuation rod 3, the respective release button 41 is pressed to push the respective positioning sheet 43 by using the multiple posts 411, the flat section 431 of the respective positioning sheet 43 removes from the accommodation groove 23 to release the respective extension 41, and the actuation rod 3 is pulled out of the accommodation groove 23 (as illustrated in FIGS. 6-8).

Thereby, the second body 2 is connected with or removed from the actuation rod 3 by ways of the locking mechanism 4 so as to clamp the workpiece quickly and easily.

While various embodiments in accordance with the present invention have been shown and described, it is clear to those skilled in the art that further embodiments may be made without departing from the scope of the present invention.

What is claimed is:

1. A fixture structure comprising: a first body, a second body, and an actuation rod;

wherein the first body includes a first clamp and a holding grip, and the actuation rod is movably accommodated and moves in the first body via the second body, the first body further includes a drive mechanism configured to pull the actuation rod, and a press lever fixed on a bottom of the first body and configured to control the drive mechanism;

wherein the actuation rod includes two extensions horizontally extending from two ends thereof, the second body includes a base, a second clamp corresponding to the first clamp, and an accommodation groove configured to receive the actuation rod;

wherein a locking mechanism is disposed in the base and includes two release button, two springs, and two positioning sheets, wherein a respective release button is arranged on each of two sides of the base, a respective spring is located inside the respective release button, and a respective positioning sheet has a flat section and two upward tilted guide sections, wherein a respective upward tilted guide section is located beside each of two sides of the flat section, the respective positioning sheet has a through orifice defined on a center thereof, and the respective positioning sheet is located at the base and is urged by the respective spring to push the flat section to engage into the accommodation groove; and wherein the respective release button has multiple posts aligned with the respective positioning sheet, when the respective release button is pressed, the multiple posts push the respective positioning sheet so that the flat section removes from the accommodation groove.

* * * * *